US007025030B2

(12) United States Patent
Leimer

(10) Patent No.: US 7,025,030 B2
(45) Date of Patent: Apr. 11, 2006

(54) VALVE STEM SEAL ASSEMBLY WITH CHANGEABLE CAP

(75) Inventor: Mark A. Leimer, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 121 days.

(21) Appl. No.: 10/646,304

(22) Filed: Aug. 21, 2003

(65) Prior Publication Data

US 2005/0040603 A1 Feb. 24, 2005

(51) Int. Cl.
*F02N 3/00* (2006.01)
*F02F 11/00* (2006.01)

(52) U.S. Cl. ..... 123/188.6; 277/502

(58) Field of Classification Search ..... 123/188.6, 123/188.9; 277/502
See application file for complete search history.

(56) References Cited

U.S. PATENT DOCUMENTS

| | | | | | |
|---|---|---|---|---|---|
| 1,551,181 | A | | 8/1925 | Tully | |
| 3,379,445 | A | | 4/1968 | Fisher | |
| 3,442,517 | A | | 5/1969 | Skinner, Sr. | |
| 3,601,420 | A | * | 8/1971 | Binford | 277/502 |
| 4,502,696 | A | * | 3/1985 | Kammeraad | 277/502 |
| 4,811,704 | A | * | 3/1989 | Boehmer et al. | 123/188.6 |
| 4,811,960 | A | | 3/1989 | Stritzke et al. | |
| 4,822,061 | A | | 4/1989 | Kammeraad | |
| 4,909,202 | A | * | 3/1990 | Binford et al. | 123/188.6 |
| 4,928,644 | A | * | 5/1990 | Travis | 23/188.6 |
| 5,002,018 | A | | 3/1991 | Strout | |
| 5,110,142 | A | | 5/1992 | Szott | |
| 5,553,869 | A | * | 9/1996 | Stamback | 277/502 |
| 6,006,778 | A | | 12/1999 | Kim | |
| 6,227,548 | B1 | * | 5/2001 | Netzer | 277/502 |
| 6,230,679 | B1 | * | 5/2001 | Hegernier et al. | 123/190.17 |
| 6,318,328 | B1 | | 11/2001 | Hegemier | |
| 6,394,463 | B1 | * | 5/2002 | Otani | 277/502 |
| 6,764,079 | B1 | * | 7/2004 | Hegemier et al. | 277/502 |

* cited by examiner

*Primary Examiner*—Thomas Moulis
(74) *Attorney, Agent, or Firm*—Rader, Fishman & Grauer, PLLC

(57) ABSTRACT

A valve stem seal assembly includes a changeable cap. The cap is made of a flexible material, such as plastic or the like. A sealing element with sealing lips for sealing the valve stem is integrally bonded to the cap. The cap includes one or more tabs with a gripping member that cooperates with a corresponding gripping member on the retainer to snap-fit the cap onto the retainer. The retainer can also be made of plastic material. Once fitted onto the retainer, the cap can be easily removed by constructively destroying the one or more tabs using a tool, such as a screwdriver. A cap with a new sealing element can then be snap-fit on the retainer. The changeable cap allows for replacement of the sealing element without replacing the retainer or other components of the valve stem seal assembly.

18 Claims, 3 Drawing Sheets

VALVE STEM SEAL ASSEMBLY WITH CHANGEABLE CAP

TECHNICAL FIELD

The present invention relates to a valve stem seal assembly, and in particular to a seal for a valve stem seal assembly found in overhead valve internal combustion engines.

BACKGROUND OF THE INVENTION

Those skilled in the art will appreciate the manner in which intake and exhaust valves are employed in cylinder heads of internal combustion engines. In conventional overhead valve internal combustion engines, a pair of valves reciprocates in timed alternation to provide intermittent communication between the intake and exhaust manifolds and a combustion chamber. As is well known, the intake port of a combustion chamber is opened and closed by the reciprocating motion of at least one intake valve. The intake valve permits fuel mixed with air to flow into the combustion chamber. In addition, an internal combustion engine has at least one exhaust valve and associated exhaust port for releasing expended combustion gases into the atmosphere. Lubrication is provided to the upper portions of the valves. Because temperatures in the combustion chamber may approach or exceed 1000 degrees Centigrade, any lubricating oil exposed to these temperatures will vaporize or burn leaving behind deposits that may interfere with the proper sealing of the valves and cause rapid deterioration. Valve stem seal assemblies are used to seal against leakage of oil between each valve guide and its associated valve stem.

It is therefore necessary to provide seals around the upper region of the valve stems and along the valve guide down to the manifolds and combustion chamber. A typical valve stem seal takes the form of a cylinder partially closed at one end by the valve seal. The cylindrical region seats about the valve guide to maintain the valve seal stationary. An upper region of the valve stem is surrounded by the valve seal when the valve stem is fully inserted into the valve seal assembly.

Conventional valve seal assemblies comprise individual body and seal components that typically must be assembled into the valve seal assembly. In addition, the valve seal assembly, valve spring and spring retainer must be assembled individually by the end user. Further, the manufacturer must keep an inventory of the valve seal assembly, valve spring and spring retainer. The inventory of such multiple components and associated assembly increases the cost of the assembled valve seal assembly.

SUMMARY OF THE INVENTION

The inventor of the present invention has recognized these and other problems associated with valve stem seal assemblies. To this end, the inventor has developed a valve stem seal assembly with a changeable cap comprising a retainer having an outer surface with a first gripping member, and a cap made of a flexible material and having a tab with a second gripping member for engaging the first gripping member on the retainer to snap-fit the cap on the retainer. The cap is capable of being snap-fit onto the retainer by moving the retainer relative to the cap such that the first gripping member engages the first gripping member. The cap is capable of being removed from the retainer by bending the tab such that the second gripping member on the cap no longer engages the first gripping member on the retainer.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
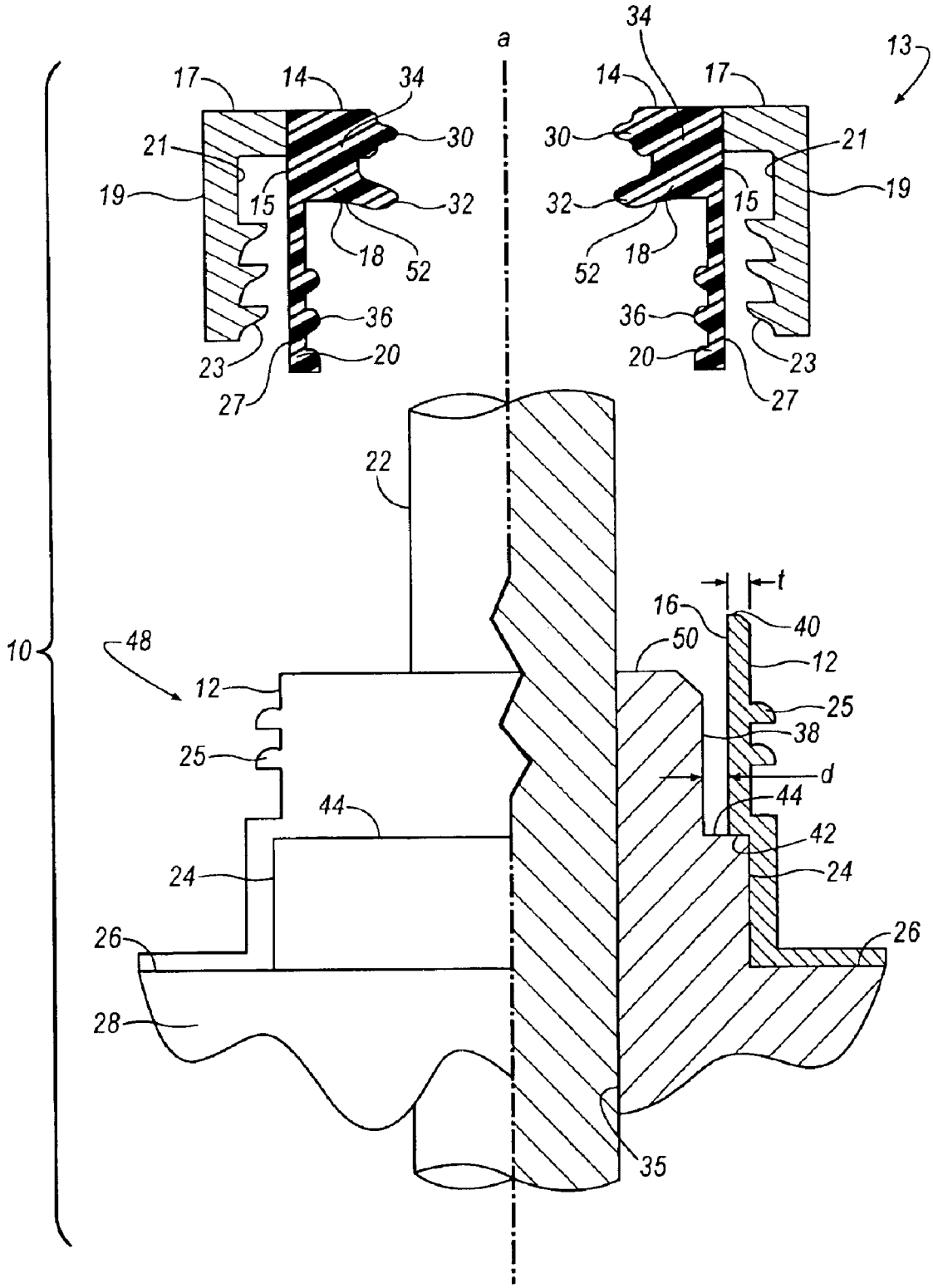
FIG. 1 is a partial cross-sectional view of a valve stem seal assembly constructed in accordance with this invention installed over a valve guide of an internal combustion engine, wherein the changeable cap with sealing element is shown prior to being snap-fit onto the retainer.

Referring now to FIGS. 1–4, a valve stem seal assembly 10 includes a retainer 12 defined by a straight walled cross-section, and a changeable cap 13 adapted to be snap-fit onto the retainer 12. Preferably, the retainer 12 and cap 13 are made of a flexible material, such as a plastic material, or the like. The valve stem seal assembly 10 is adapted to sealingly engage a valve stem 22 supported in an annular valve guide 24 for reciprocal movement of the stem in the guide along a longitudinal axis a—a, as will be appreciated by those skilled in the art. The valve guide 24 extends from an upper surface 26 of a cylinder head deck 28. For this purpose, the guide 24 may be machined from a cylinder head deck casting that includes the guide. Alternatively, the cylindrical guide 24 may be press fit into an aperture (not shown) formed in the cylinder head deck.

Figure 3:
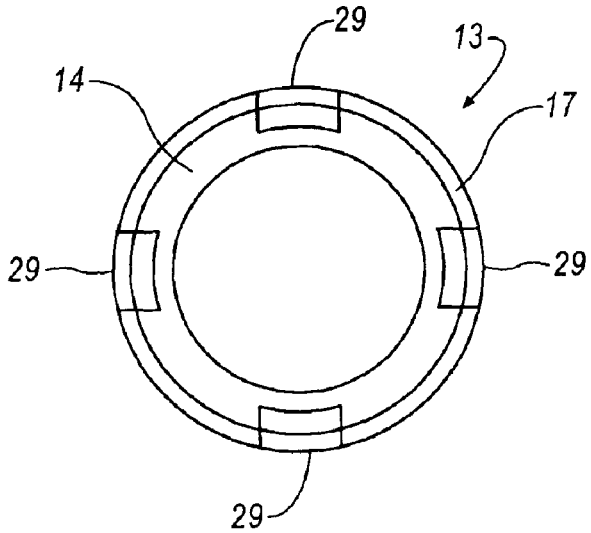
FIG. 3 is a top view of the changeable cap with sealing element in accordance with this invention.
Figure 4:
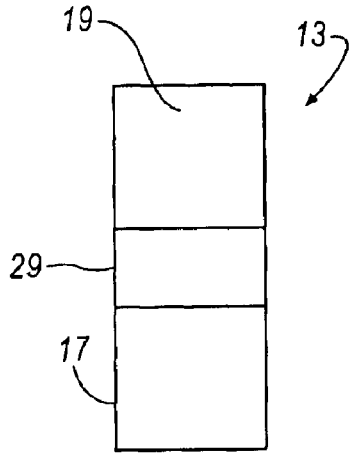
FIG. 4 is a side view of the changeable cap with sealing element of FIG. 3.

The cap 13 is generally annular in shape defining an upper portion 17 and a lower portion 19. As shown in FIG. 3, the cap 13 includes one or more break-away tabs 29 extending from the upper portion 17 to the lower portion 19. An interior surface 21 of each break-away tab 29 includes one or more gripping members or ribs 23 adapted to engage one or more gripping members or ribs 25 extending outwardly from the retainer 12. In the illustrated embodiment, the cap 13 includes four break-away tabs 29 positioned approximately ninety degrees from each other. However, it will be appreciated that the invention is not limited by the number of break-away tabs 29, and that the invention can be practiced with any desired number of tabs to properly snap-fit the cap 13 onto the retainer 12.

Figure 2:
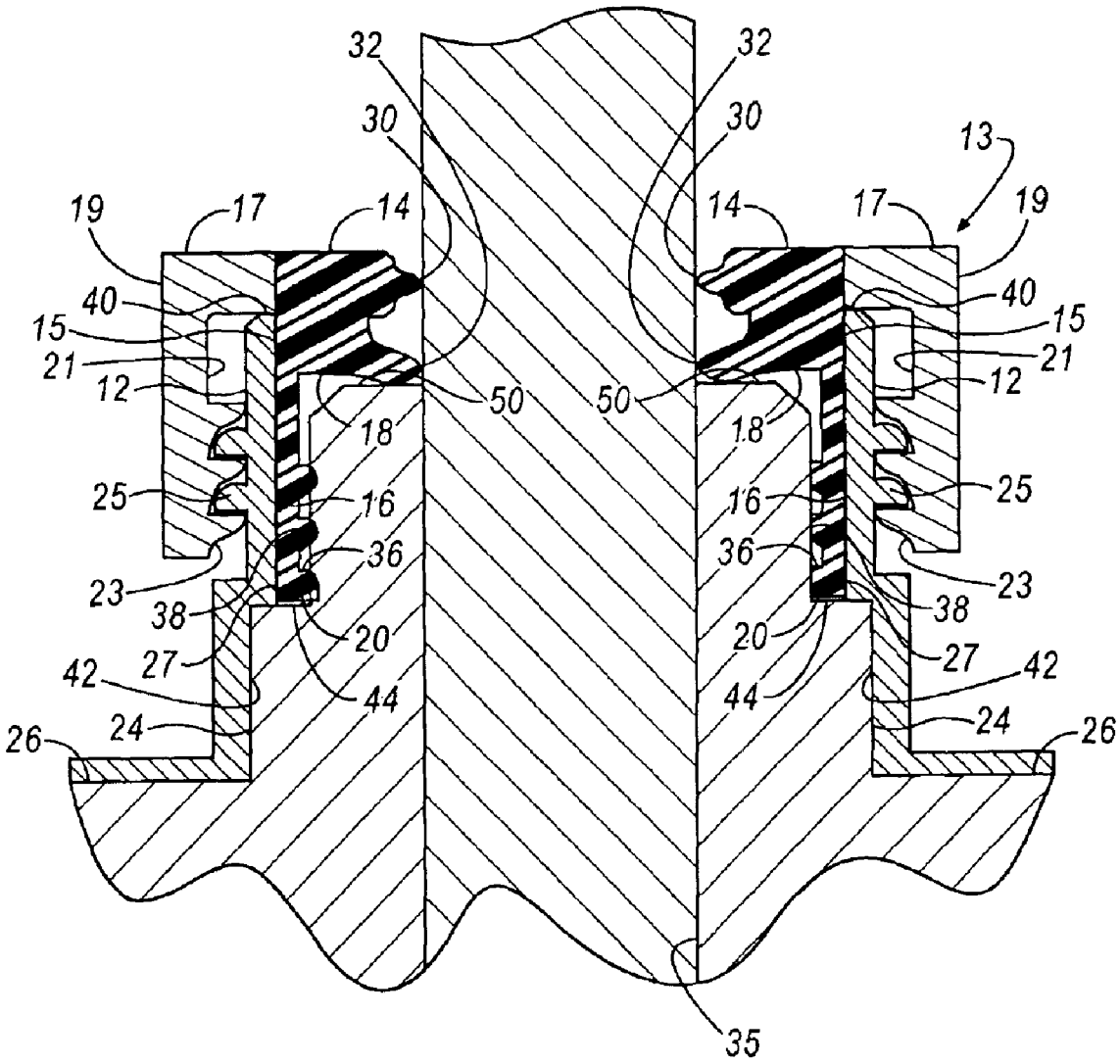
FIG. 2 is a partial cross-sectional view of the valve stem seal assembly constructed in accordance with this invention installed over a valve guide of an internal combustion engine, wherein the changeable cap with sealing element is shown being snap-fit onto the retainer.

Bonded to an interior surface 15 of the upper portion 17 of the cap 13 is an elastomeric sealing material, commonly referred to as a rubber jacket 14. The jacket 14 can be bonded to the plastic cap 13 by chemical bonding, or the like. An elastomeric upper body portion 18 and a contiguous elastomeric lower body portion 20 together define the jacket 14. An exterior surface 27 of the jacket 14 is spaced from the ribs 23 approximately equal to a thickness, t, of the retainer 12. In addition, the retainer 12 is spaced from the guide 24 by a distance, d, such that the retainer 12 can be received between the jacket 12 and the cap 13, and the jacket 12 can be received between the guide 24 and the retainer 12, as shown in FIG. 2.

The upper body portion 18 of the rubber jacket 14 contains an oil sealing lip 30 adapted for contact with the cylindrical surface of the valve stem 22. A gas sealing lip 32 may be longitudinally spaced from the lip 30 and positioned proximally to the interface between the valve stem 22 and the valve guide 24. Those skilled in the art will appreciate that the gas sealing lip 32 is not required in all applications. Whether or not present, however, those skilled in the art will also appreciate that the lip 30 (and gas sealing lip 32) are sized to assure proper lubrication and consequent avoidance of premature damage to the lip 30 (and gas sealing lip 32) due to friction, as well as any frictional scouring of the valve stem 22.

For this purpose, the space between the upper body portion 18 and the valve stem 22 characterizes a sealing interface 34 by which the oil sealing lip 30 and (the gas sealing lip 32) are effective for metering oil between the assembly 10 and the valve stem 22, and for assuring appropriate lubrication of a guide interface 35 between the valve stem and the valve guide 24.

The lower body portion 20 of the rubber jacket 14 is characterized by a plurality of gripping ribs 36. There are a pair of such ribs 36 in the described embodiment that are adapted to frictionally retain the valve assembly 10 on a reduced diameter portion 38 of the guide 24. Obviously, the ribs 36 are sized relative to the outside diameter of the reduced diameter portion 38 to provide a valve stem seal retention force capable of resisting mechanical pressures attempting to remove or dislodge the seal 10 from the guide 24 during engine operation. Although only two such ribs 36 are displayed in the described embodiment, the number of ribs can be varied, commensurate with retention force requirements for any given application.

As will be apparent from FIG. 1, the reduced diameter portion 38 of the valve guide 24 creates an annular step 44 that is formed by the distinct diameters of the lower and upper, longitudinally and symmetrically aligned, portions 24 and 38 of the guide. The retainer 12 has an upper extremity 40, and a lower extremity 42; the lower extremity 42 bears against a step 44, and hence the step 44 acts as a positive insertion stop for the valve stem seal assembly 10 during installation. It will be appreciated that the upper extremity 50 of the guide portion 38 is vertically spaced from the bottom 52 of the upper body portion 18 to optimize sealing effectiveness.

One aspect of the invention is that the cap 13 with the jacket 14 bonded thereto can be snap-fit onto the retainer 12. To snap-fit the cap 13 with the jacket 14 onto the retainer 12, the lower body portion 20 of the jacket 14 is positioned between an interior surface 16 of the retainer 12 and the guide 24. At the same time, the retainer 12 is positioned between the interior surface 21 of the cap 13 and the exterior surface 27 of the jacket 14, as shown in FIG. 1. Once positioned properly, the cap 13 and jacket 14 can be moved relative to the retainer 12 to form an interference fit between the jacket 14 and the retainer 12 and the guide 24 such that exterior surface 27 of the jacket 14 sealingly engages the interior surface 16 of the retainer 12 and the sealing lips 36 of the jacket 14 sealingly engage the guide 24. In addition, the ribs 23 of the cap 13 engage the ribs 25 of the retainer 12 to removably retain the cap 13 with the jacket 14 to the retainer 12, as shown in FIG. 2.

Figure 5:
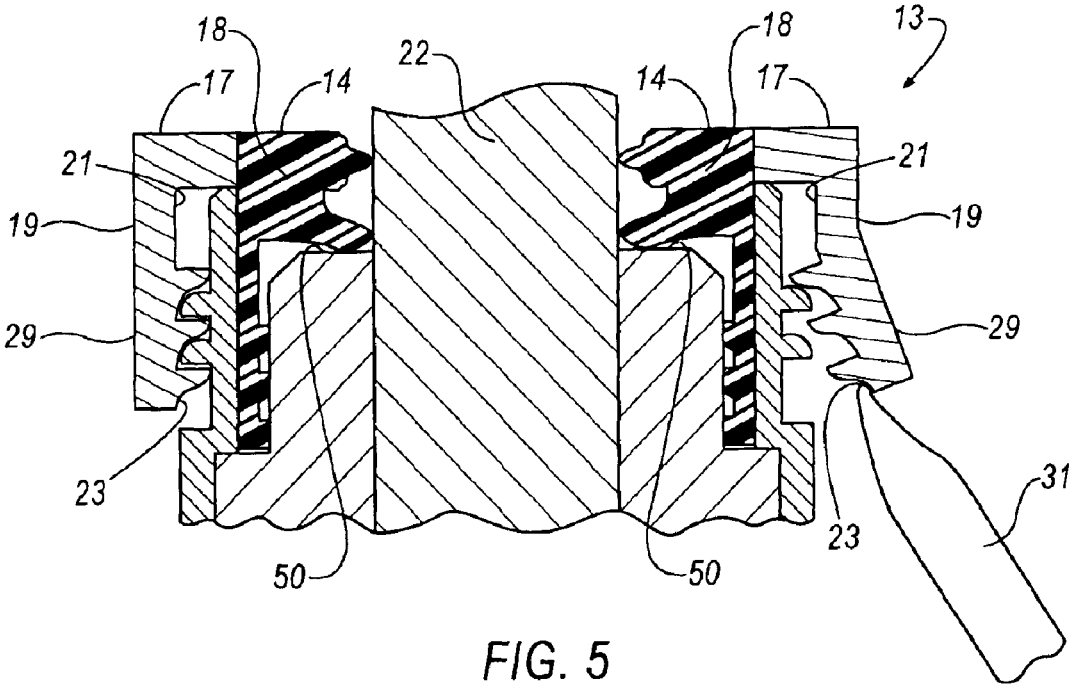
FIG. 5 is a cross-sectional view of the valve stem seal assembly constructed in accordance with this invention, wherein the changeable cap with sealing element is being removed from the retainer.

Another aspect of the invention is that the cap 13 with the jacket 14 bonded thereto once snap-fit onto the retainer 12 can be constructively removed from the retainer 12, thereby providing a changeable cap feature of the invention. To constructively remove the cap 13 with the jacket 14 from the retainer 12, a tool 31, such as a screwdriver, or the like, can be positioned underneath the one or more break-away tabs 29 on the lower portion 19 of the cap 13, as shown in FIG. 5. Once positioned underneath the break-away tabs 29, the tabs 29 are bent in an upward direction away from the retainer 12 such that the ribs 23 on the cap 13 no longer engage the ribs 25 on the retainer 12. After the tabs 29 are bent, the cap 13 with the jacket 14 can be easily removed from the retainer 12.

In summary, this invention is characterized by a valve stem seal assembly 10 comprising a retainer 12 and a changeable cap 13 with an elastomeric sealing element 14 chemically bonded to the cap 13. The cap 13 with sealing element 14 can be snap-fit onto the retainer 12, and constructively removed from the retainer 12 such that a new cap with sealing element can be snap-fit onto the retainer 12. The retainer 12 and the cap 13 can be made of a flexible material, such as plastic, or the like. The new cap can be the same design or a different design from the original cap. Thus, the present invention allows for the sealing element 14 to be replaced without the need for replacing the entire valve stem seal assembly, thereby reducing the costs associated therewith.

It should be understood that the aforementioned and other various alternatives to the embodiments of the invention described herein may be employed in practicing the invention. It is intended that the following claims define the scope of the invention and that the method and apparatus within the scope of these claims and their equivalents be covered thereby.

What is claimed is:

1. A valve stem seal assembly with changeable cap, comprising:

a retainer having an outer surface with a first gripping member; and a cap made of a flexible material and having at least one break-away tab with a second gripping member for engaging the first gripping member on the retainer to snap-fit the cap on the retainer, wherein the cap is capable of being removed from said retainer by bending the at least one break-away tab such that the second gripping member on said cap no longer engages the first gripping member on said retainer.

2. The valve stem seal assembly according to claim 1, further comprising a sealing element bonded to the cap.

3. The valve stem seal assembly according to claim 1, wherein said retainer is made of a flexible material.

4. The valve stem seal assembly according to claim 3, wherein said retainer is made of a plastic material.

5. The valve stem seal assembly according to claim 1, wherein said cap is made of a plastic material.

6. The valve stem seal assembly according to claim 1, wherein said sealing element is made of an elastomeric material.

7. A valve stem seal assembly, comprising:

a retainer having an outer surface with a first gripping member; and a cap made of a flexible material and having at least one break-away tab with a second gripping member for engaging the first gripping member on the retainer, wherein said cap is capable of being snap-fit onto said retainer by moving said retainer relative to said cap such that the second gripping member engages said first gripping member, and wherein said cap is capable of being removed from said retainer by bending the at least one break-away tab such that the second gripping member on said cap no longer engages the first gripping member on said retainer.

8. The valve stem seal assembly according to claim 7, further comprising a sealing element bonded to the cap.

9. The valve stern seal assembly according to claim 7, wherein said retainers made of a flexible material.

10. The valve stem seal assembly according to claim 9, wherein said retainers made of a plastic material.

11. The valve stem seal assembly according to claim 7, wherein said cap is made of a plastic material.

12. The valve stem seal assembly according to claim 7, wherein said scaling element is made of an elastomaric material.

13. A valve stem seal assembly with changeable cap, comprising:

a retainer having an outer surface with at least one first rib extending outward from the outer surface; and a cap made of a flexible material and having at least one break-away tab with at least one second rib extending inward of the cap for engaging the first rib on the retainer to snap-fit the cap on the retainer, wherein the cap is capable of being removed from said retainer by bending the at least one break-away tab such that the second rib on said cap no longer engages the first rib on said retainer.

14. The valve stern seal assembly according to claim 13, further comprising a sealing element bonded to the cap.

15. The valve stem seal assembly according to claim 13, wherein said retainer is made of a flexible material.

16. The valve stem seal assembly according to claim 15, wherein said retainer is made of a plastic material.

17. The valve stem seal assembly according to claim 13, wherein said cap is made of a plastic material.

18. The valve stem seal assembly according to claim 13, wherein said sealing clement is made of an elastomeric material.

* * * * *